US005376014A

United States Patent [19]

Sumida

[11] Patent Number: 5,376,014

[45] Date of Patent: Dec. 27, 1994

[54] CONNECTOR ASSEMBLY

[75] Inventor: Tatsuya Sumida, Yokkaichi, Japan

[73] Assignee: Sumitomo Wiring Systems, Ltd., Yokkaichi, Japan

[21] Appl. No.: 137,464

[22] Filed: Oct. 18, 1993

[30] Foreign Application Priority Data

Oct. 21, 1992 [JP] Japan ..... 4-282885

[51] Int. Cl.[5] ..... H01R 13/62

[52] U.S. Cl. ..... 439/310; 439/352

[58] Field of Search ..... 439/310, 345, 350, 351, 439/352, 353, 355, 357

[56] References Cited

U.S. PATENT DOCUMENTS 5,135,408 8/1992 Suzuki ..... 439/310

5,192,222 3/1993 Krause et al. ..... 439/310 X

FOREIGN PATENT DOCUMENTS 63-99788 6/1988 Japan .

2278674 11/1990 Japan .

3269965 12/1991 Japan .

*Primary Examiner*—Khiem Nguyen

*Attorney, Agent, or Firm*—Sandler, Greenblum & Bernstein

[57] ABSTRACT

A connector assembly has a pair of male and female connectors which are engaged together to electrically connect male and female terminals provided in the male and female connectors. The female connector comprises a connector housing, spring, and a retainer. Engaging steps on the ends of the flexible arms of the retainer engage the engaging projections on the connector housing, and the spring is held between the connector housing and the retainer in a compressed state. When the female connector is inserted to a male connector, locking arms provided to the retainer interlocks with the locking holes formed in the male connector. At this position, tapered faces provided in the male connector wedge into a space between the flexible arms and the engaging projections to release the engagement, resulting in releasing the tensile force of the compressed spring, and forcing the connector housing to advance towards the male connector.

5 Claims, 5 Drawing Sheets

CONNECTOR ASSEMBLY

BACKGROUND OF THE INVENTION

1. Field of the Invention

The present invention relates to a connector assembly and, more particularly, to a connector assembly having a pair of male and female connectors in which the male connector and the female connector are coupled to electrically connect terminals provided in the male and female terminals, and which reduces the coupling force of the male and female connectors using the spring tension of the spring member, and can be coupled with a single action.

2. Description of the Prior Art

In a general connector assembly, male and female connectors are manually coupled, and wire harnesses with plural terminals in each single connector are used to minimize the number of connectors, or to conversely maximize the number of terminals that can be connected with a single operation in order to increase job productivity. As the number of terminals per connector increases, however, so does the strength or force required to assure a positive connection.

Various connectors have therefore been proposed as a means of reducing the coupling force required with such connectors. For example, in the connector shown in FIG. 7, a lever 2 comprising a guide channel 2*a* is provided in one of the connectors 1, and a boss 4 engaging this guide channel 2*a* is provided in the other connector 3.

When the connectors are coupled, the one connector 1 is inserted partially into the other lever 2 to a semi-inserted position, and the lever 2 is then turned. The boss 4 is thus guided into the guide channel 2*a* by rotation of the lever 2 using the simple principle of a lever and fulcrum. As a result, the worker can positively couple the male and female terminals with less manual strength required compared with manually inserting the connector 1 all the way into the other connector 3. (Japanese Patent laid-open Publication No. 2-278674.)

The problem with this conventional connector is that two operations, partial insertion and lever 2 rotation, are required to couple the connectors. It is also possible for the worker to forget to turn the lever 2, resulting in a partially inserted, partially coupled condition that can lead to faulty connections.

In addition, the lever 2 is held by an engaging member 5 in a semi-fixed position from which the boss 4 can be aligned with the guide channel 2*a* before the lever 2 is turned. During shipping, however, an external force applied to the lever 2 can release this semi-fixed position, allowing the lever 2 to rotate and close the guide channel 2*a*. When this happens, the worker must turn the lever 2 back to the open, semi-fixed position before the boss 4 can be aligned with the guide channel 2*a* and the coupling completed.

In addition to connectors that reduce the required coupling force by means of a lever mechanism, connectors that have a gear 9 provided on the leading edge of a lever 8 in one connector 7 to engage a rack 11 provided on the inside bottom of the other connector 10 have also been proposed as a way to reduce the required coupling force. (Japanese Utility Model laid-open Publication No. 63-99788.)

In addition to the extreme complexity of this gear 9 and rack 11 construction, however, the large number of components required increases the cost and minimizes the practical benefits of this design.

SUMMARY OF THE INVENTION

The present invention, therefore resolves these problems of the prior art by providing a connector assembly of simple construction that reduces the required coupling force, can be positively coupled with a single operation, and is unaffected by external forces applied during shipping.

To achieve this object, a connector assembly according to the present invention has a pair of first and second connectors which are engaged together to electrically connect terminals provided in the first and second connectors. According to the present invention, the first connector comprises: a connector housing carrying at least one first terminal and having a first engaging means; a retaining member having a second engaging means engaged to the first engaging means and a first locking means, and a spring member provided in a compressed state in a space between the connector housing and the retaining member while the first and second engaging means are in an engaged condition, for forcing the connector housing towards the coupling direction. The second connector, carrying at least one second terminal, comprises: a second locking means interlocking with the first locking means for engaging the retaining member to the second connector; and a disengaging means for releasing the engagement between the first and second engaging means when the first and second locking means are interlocked and releasing the spring tension of the spring member, whereby the connector housing is advanced towards the second connector by the spring force to accomplish electrical connection between the first and second terminals.

Specifically, the first engaging means provided on the connector housing of the first connector is preferably an engaging projection comprising an engaging surface. The second engaging means provided on the retaining member of the first connector is preferably a flexible arm comprising a tapered face and engaging step on the end thereof. The first locking means provided on the retaining member is preferably a locking arm providing an engaging projection on the end thereof.

The second locking means provided on the second connector is preferably a lock hole coupling with the engaging projection of the locking arm. In addition, the disengaging means of the second connector is preferably a tapered member guiding the tapered face of the engaging arm and bending the engaging arm.

In addition, the spring tension of the spring member is preferably greater than the force required to couple the first and second connectors.

When the worker inserts the first connector into the second connector using a connector comprised according to the present invention as described above, the engaging projection on the leading end of the locking arm of the retaining member of the first connector engages the lock hole of the second connector. The tapered face provided on the leading end of the engaging arm of the retaining member is guided and flexed by the tapered member, thus releasing engagement of the engaging projection on the connector housing with the engaging step of the engaging arm end. When engagement of the connector housing and retaining member is thus released, the spring tension of the spring member compressed therebetween is released, and the connector housing is automatically coupled with the second connector.

BRIEF DESCRIPTION OF THE DRAWINGS

The present invention will become more fully understood from the detailed description given below and the accompanying diagrams wherein.

DESCRIPTION OF PREFERRED EMBODIMENTS

Figure 1:
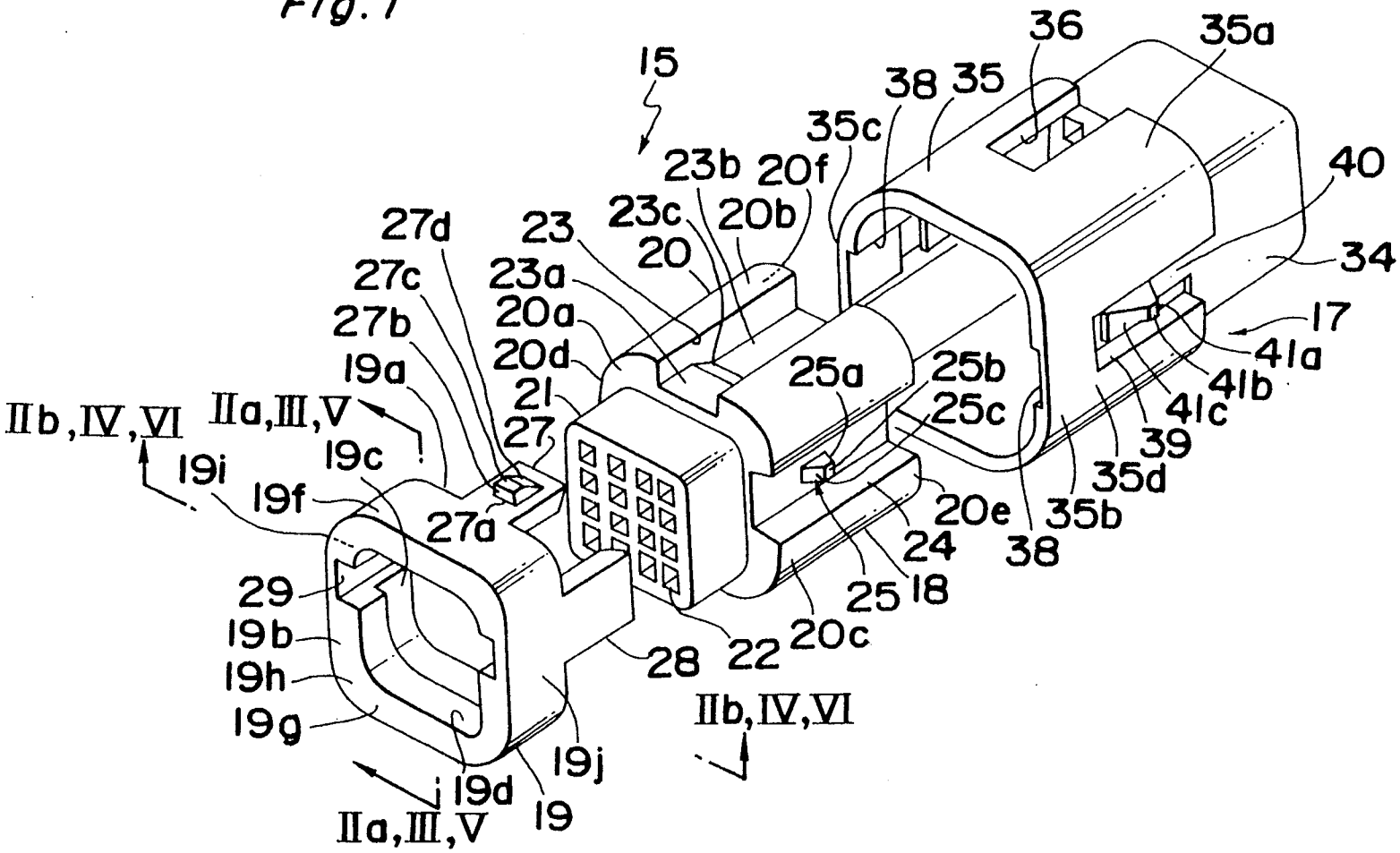
FIG. 1 is an exploded perspective view of the preferred embodiment of the invention.

The preferred embodiment of a connector assembly according to the invention is described below with reference to the accompanying figures.

A connector assembly according to the present invention comprises a female connector 15 in which plural female terminals (not shown in the figures) are installed and a male connector 17 comprises male terminals 16 for the connection with the female terminals.

The female connector 15 further comprises a separate retaining member 19 assembled to the connector housing 18.

The connector housing 18 comprises a projecting member 21 integral to and projecting from the back face 20*a* of the main member 20. The main member 20 and the projecting member 21 are approximately square in cross section with the cross sectional area of the projecting member 21 less than that of the main member 20.

Plural terminal sockets 22 are provided in the connector housing 18 as through holes passing lengthwise to the main member 20 and projecting member 21. The female terminals (not shown in the figures) are placed inside the terminal sockets 22 by insertion from the mouths on the projecting member 21 side.

First channels 23, which have a rectangular cross section, are provided lengthwise in the pair of opposing top and bottom outside surfaces 20*b* and 20*c* of the main member 20 such that the locking arms 27 of the retaining member 19 (described below) are positioned in these first channels 23. These first channels 23 further comprise a relatively shallow first part 23*a* extending from the back face 20*a* end and a relatively deep second part 23*b*. The first and second parts 23*a*, 23*b* are connected by a tapered face 23*c*.

Second channels 24, which also have a rectangular cross section, are provided lengthwise in the other pair of opposing outside surfaces 20*d* and 20*e* of the main member 20 such that the other pair engaging arms 28 of retaining member 19 are positioned in these second channels 24.

Engaging projections 25, which are the first engaging projections, are formed on the bottom surface of the second channels 24. The engaging projections 25 are provided at a level lower than the center axis of the second channels 24. One face of the engaging projections 25 close to the side of the leading end 20*f* is perpendicular to the bottom surface of the second channels 24 and forms the engaging face 25*a* of the engaging projections 25. A top face 25*b* is provided parallel to the bottom and contiguous to the engaging face 25*a*, and is contiguous to the tapered face 25*c* sloping down towards the back face 20*a* of the engaging projections 25. As will be described later, the engaging face 25*a* of the engaging projections 25 engages the engaging step 30 of the engaging arms 28.

The retaining member 19 is a rectangular annular member comprising a first inside circumference 19*c* and a second inside circumference 19*d*. The first inside circumference 19*c* has a size to enable free insertion of the main member 20 from the front face 19*a*, and the second inside circumference 19*d* has a size to enable free insertion of only the projecting member 21. The first inside circumference 19*c* and second inside circumference 19*d* are joined by step 19*e*.

Locking arms 27, which are the first locking means, project integrally from the front face 19*a* of the pair of opposing side walls 19*f* and 19*g* of the retaining member 19. An engaging projection 27*a* is provided on the outside face of the leading end of each locking arm 27.

The engaging projections 27*a* has an engaging face 27*b* facing toward the back face 19*h* and perpendicular to the surface of the locking arm 27, a top face 27*c* parallel to the surface of the locking arm 27 and contiguous to the engaging face 27*b*, and a tapered face 27*d* contiguous to face 27*b* and sloping down toward the front face 19*a*.

A pair of engaging arms 28, which are the second engaging means, project integrally from the front face 19*a* of the other pair of side walls 19*i*, 19*j* of the retaining member 19.

The inside surface of the leading end of each engaging arm 28 has a tapered face 28*a*, which slopes down toward the outside end thereof. Third channels 29 having a rectangular cross section are provided from the back face 19*h* to a position close to the tapered face 28*a* at the inside of the engaging arms 28. The front ends of these third channels 29 are the engaging steps 30.

When the projecting member 21 is inserted into the second inside circumference 19*d*, the retaining member 19 is mounted into the back end of the connector housing 18, and the locking arms 27 and engaging arms 28 are guided along the first and second channels 23 and 24, respectively.

Before the projecting member 21 is inserted to the second inside circumference 19*d*, a spring member 32 (not shown in FIG. 1), which is a coil spring, is compressed between the retaining member 19 and the connector housing 18.

The spring member 32 fits freely around the projecting member 21, one end contacting the step 19*e* of the retaining member 19 and the other end contacting the back face 20*a* of the main member 20 such that tension is applied to force the retaining member 19 and connector housing 18 apart in opposite directions. When the locking arms 28 are positioned in the second channels 24 with the engaging steps 30 of the retaining member 19 in contact with the engaging faces 25*a* of the engaging projections 25 in second channel 24, the spring tension forcing the retaining member 19 and connector housing 18 apart is held in a compressed state, and the retaining member 19 is thus integrally assembled to the connector housing 18.

Note that the material, dimensions, and compressed vs. natural length of the spring member 32 are determined so that the spring tension thereof is greater than the force (coupling force) required to couple the male connectors 17 to the female connectors 15.

The male connector 17 comprises a terminal housing member 34 in which the male terminals 16 (FIG. 3) are provided, and a mating connector coupling member 35 in front of the terminal housing member 34. The mating connector coupling member 35 has a rectangular, ring-shaped cross section, and houses the female connector 15 inside. The ends of the male terminals 16 project to the inside of this mating connector coupling member 35.

Lock holes 36 forming the second locking means are provided in the pair of opposing sides 35*a*, 35*b* of mating connector coupling member 35 in the lengthwise direction of the terminal housing member 34.

Rectangular cross section channels 38 are provided on the inside of the other opposing sides 35*c* and 35*d* of the mating connector coupling member 35. A cut-out 39 continuous to the channel 38 is provided in each of the opposing sides 35*c* and 35*d* from the lengthwise center thereof.

A closing member 40 closing a portion of each cut-out 39 is provided on the inside of each cut-out 39 from the terminal housing member 34 side to the lengthwise center thereof. Note that the closing member 40 is provided at a level higher than the center axis of the cut-out 39 (channel 38) so that when the male connector 17 is coupled to the female connector 15, the engaging projections 25 are guided along the cut-outs 39, just below the closing member 40.

At the end of each closing member 40, a male-side taper 40a forming the disengaging means is provided. One side of this male-side taper 40*a* which is close to the terminal housing member 34 forms the engaging face 41*a* perpendicular to the closing member 40. Contiguous to the engaging face 41*a* and parallel to the closing member 40 is top face 41*b*, which is contiguous to tapered face 41*c* sloping down to the end thereof.

Figure 2A:
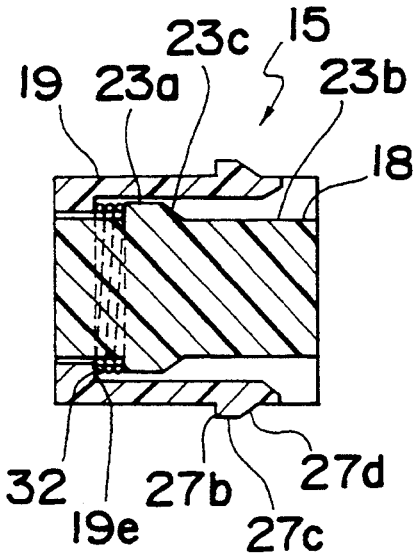
FIGS. 2*a* and 2*b* are cross sectional views at line II*a* and II*b*, respectively, shown in FIG. 1 of the female connector of the preferred embodiment.
Figure 2B:
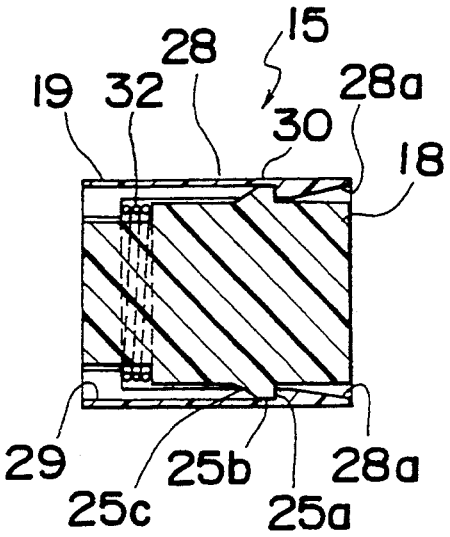

The connector assembly described above is coupled as follows. First, the retaining member 19 and the connector housing 18 are coupled with the compressed spring member 32 held therebetween in a manner shown in FIGS. 2*a* and 2*b* to define a female connector 15. Then, the female connector 15 and the male connector 17 are held such that the free ends of the locking arms 27 of the female connector 15 are in alignment with the lock holes 36 of the male connector 17, and the free ends of the engaging arms 28 of the female connector 15 are in alignment with the tapers 40*a* of the male connector 17, and the female connector 15 is inserted into to the male connector 17 in the direction of arrow C in FIGS. 3 and 4.

Figure 3:
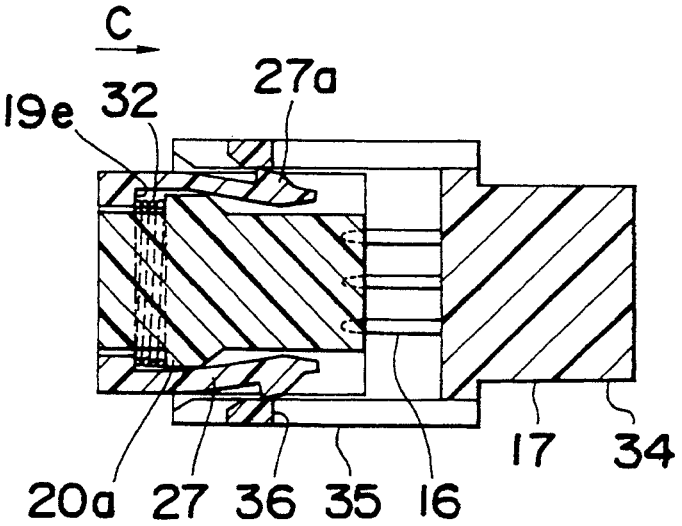
FIG. 3 is a cross sectional view at line III—III when the male and female connectors of the preferred embodiment are coupled.

As the female connector 15 is inserted to the position shown in FIG. 3, the ends of the engaging projections 27*a* contact the inside face of the coupling member 35 of the male connector 17, and the locking arms 27 are flexed to the inside of coupling member 35.

Figure 4:
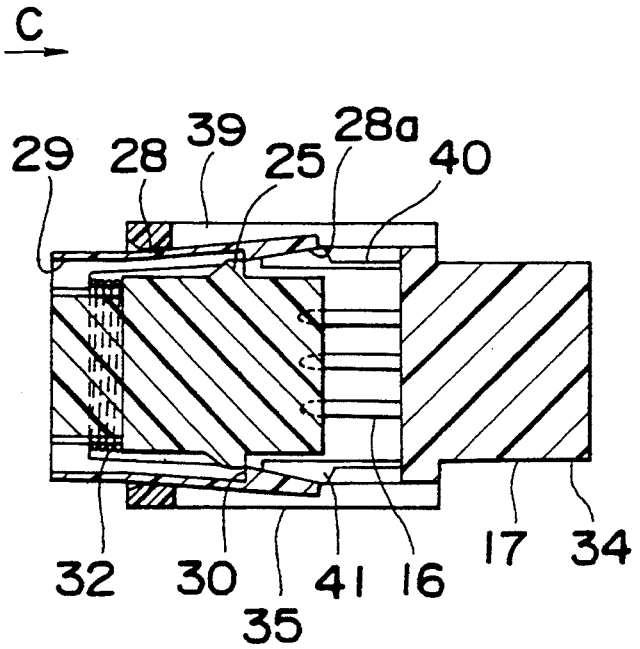
FIG. 4 is a cross section at line IV—IV when the male and female connectors of the preferred embodiment are coupled.

As shown in FIG. 4, at this position, the tapered faces 28*a* contact the tapered faces 41*c* of the tapers 41 on the male connector 17, and the engaging arms 28 of the retaining member 19 are flexed to the outside, as shown in FIG. 4. In the states shown in FIGS. 3 and 4, the engaging steps 30 on the leading ends of the engaging arms 28 and the engaging faces 25*a* of the engaging projections 25 are still in the engaged position, and the spring member 32 is held compressed between the retaining member 19 and connector housing 18.

Figure 5:
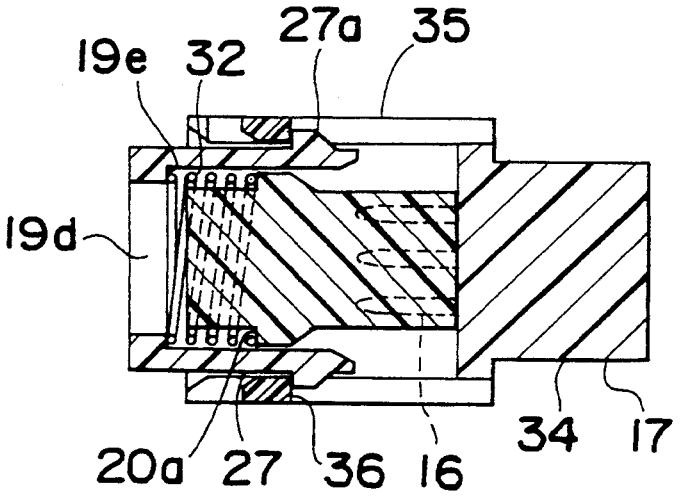
FIG. 5 is a cross section at line V—V when the male and female connectors of the preferred embodiment are coupled.
Figure 6:
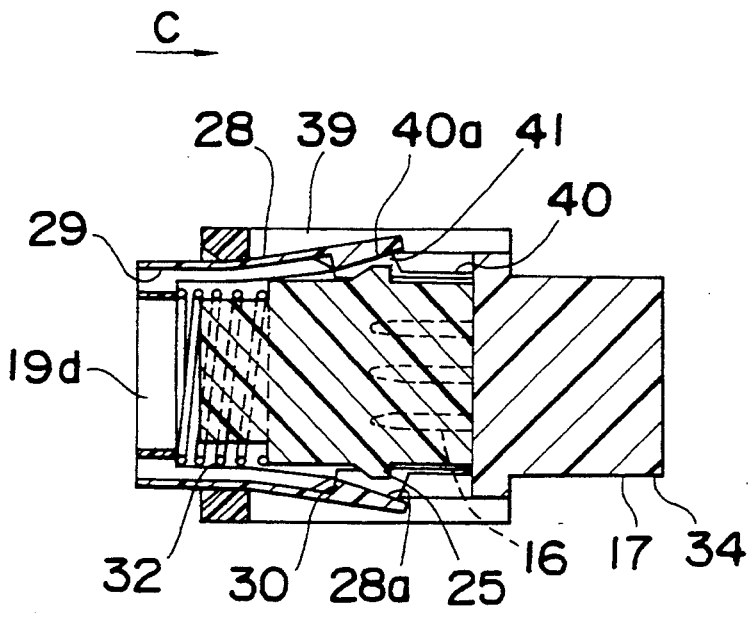
FIG. 6 is a cross section at line VI—VI when the male and female connectors of the preferred embodiment are coupled.
Figure 7:
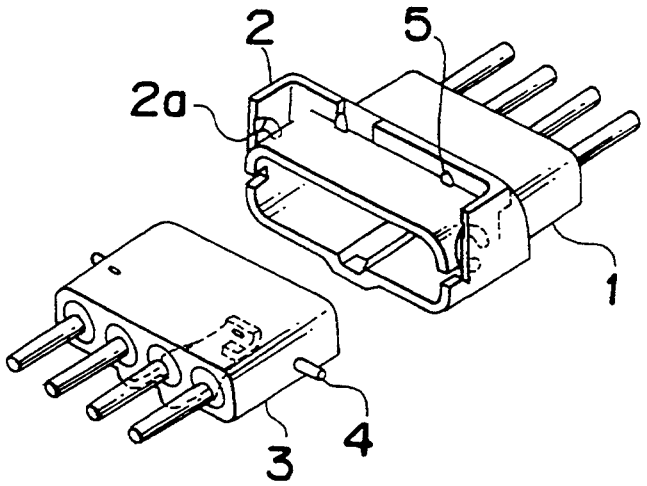
Fig. 7 PRIOR ART
FIG. 7 is a perspective view of the prior art connector.
Figure 8:
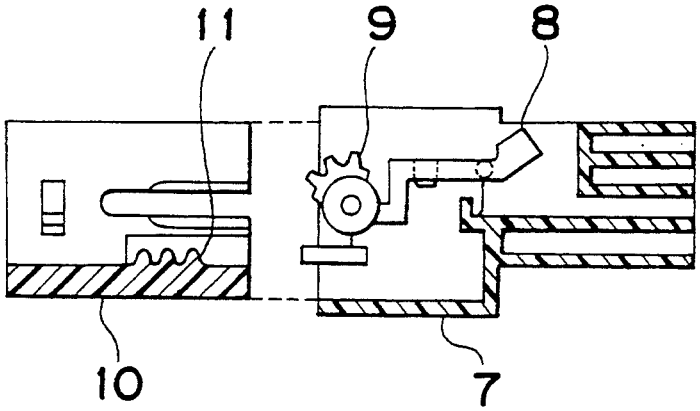
Fig.8 PRIOR ART
FIG. 8 is a cross sectional view of another example of the prior art connector.

Then, by a further insertion of the female connector 15 into the male connector 17 in the direction of arrow C in FIG. 4, the engaging projections 27*a* on the leading end of the locking arms 27 fit into the lock holes 36 of the male connector 17 as shown in FIG. 5.

When the engaging projections 27*a* fit in the lock holes 36, the tapered faces 28*a* contact the tapered faces 41*c* of the tapers 41, forcing the engaging arms 28 of the retaining member 19 further to the outside so that the engaging faces 25*a* of the engaging projections 25 disengage from the engaging steps 30. In other words, the tapers 41 wedge into spaces under the engaging arms 28 to lift off the engaging arms 28 from the bottom of the second channels 24, resulting in disengagement between the projections 25 and steps 30.

Because the retaining member 19 and connector housing 18 are thus integrally assembled against the tensile force of the spring member 32 by engagement of engaging steps 30 with engaging faces 25*a*, a tensile force works when this engagement is released so as to drive the retaining member 19 and connector housing 18 apart in opposite directions.

Because the engaging projections 27*a* of the locking arms 27 are fitted in the lock holes 36 at this timer the engaging faces 27*b* of the engaging projections 27*a* and the edges of the lock holes 36 engage, and movement of the retaining member 19 in the direction separating from the connector housing 18 is restricted. As a result, the spring tension of the compressed spring member 32 becomes a force separating the connector housing 18 from the retaining member 19 when the spring member 32 is released, and the connector housing 18 is thus automatically coupled to the female connector 15 by the force of this spring member.

As a result, when the female connector 15 is simply inserted to the male connector 17, according to this preferred embodiment of the invention, the male and female connectors can be automatically coupled using the tension of the spring member 32 without any application of great external pushing force.

It is to be noted that the invention shall not be limited to the above embodiment, and can be varied in many ways. For example, while a retaining member and spring member are provided in the female connector of this embodiment, it is also possible to provide the retaining member on the male connector and compress the spring member therebetween.

In addition, the specific configuration of the locking arms, lock holes, engaging arms, and other components shall not be restricted to the above example, and it shall be sufficient if one connector comprises a connector housing and a retaining member engaged with the connector housing such that a spring member forcing the connector housing in the coupling direction is held in a compressed state, and is comprised to release the spring tension of the spring member by releasing engagement of the retaining member and connector housing when the other connector engages the retaining member of the first connector.

As will be obvious from the above description, because one connector compresses a spring member between the connector housing and retaining member, the retaining member comprises a locking arm and an engaging arm engaging the connector housing in resistance to the tensile force of the spring member, and the other connector comprises a lock hole engaging the locking arm and a tapered face guiding and flexing the end of the engaging arm to release engagement of the engaging arm and connector housing, both connectors can be automatically coupled by the tensile force of the spring member when the worker simply inserts the one connector to the other, and the amount of force required to couple the connectors can be reduced.

In addition, the connector assembly according to the present invention is not affected by external forces applied during shipping, and the male and female connectors can be reliably coupled together because the retaining member and connector housing are integrally assembled by the engaging projections of the connector housing side and the engaging arms of the retaining member side engaging with the tensile force of the spring member compressed between the retaining member and connector housing.

In addition, a connector assembly according to the present invention can achieve the above effects, can reduce connector cost, and increase productivity by means of a relatively simple construction whereby a spring member is compressed between the retaining member and connector housing of one connector.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connector assembly having a pair of first and second connectors which are engaged together to electrically connect terminals provided in said first and second connectors, said connector assembly comprising:

(I) said first connector comprising:

a connector housing carrying at least one first terminal and having a first engaging means:

a retaining member having a second engaging means for engaging said first engaging means and a first locking means, and a spring member provided in a compressed state in a space between said connector housing and said retaining member while said first and second engaging means are in an engaged condition, said spring member forcing said connector housing towards the coupling direction; and (II) said second connector carrying at least one second terminal, said second connector comprising:

a second locking means interlocking with said first locking means for engaging said retaining member to said second connector; and a disengaging means for releasing the engagement between said first and second engaging means when said first and second locking means are interlocked and for releasing the spring tension of the spring member, whereby said connector housing is advanced towards the second connector by the spring force to accomplish electrical connection between said first and second terminals.

2. A connector assembly according to claim 1, wherein said first and second engaging means are a projection provided on said connector housing and a recess provided in said retaining member, respectively.

3. A connector assembly according to claim 1, wherein said first and second locking means are a projection provided on said retaining member and a recess provided in said second connector, respectively.

4. A connector assembly according to claim 1, wherein said disengaging means is a wedge which is inserted between said first and second engaging means.

5. A connector assembly according to claim 1, wherein said spring member has a spring tension greater than the force required to insert said connector housing into said second connector.

* * * * *